US008431017B2

(12) United States Patent
Varadaraj

(10) Patent No.: US 8,431,017 B2
(45) Date of Patent: Apr. 30, 2013

(54) GEL ASSISTED SEPARATION METHOD AND DEWATERING/DESALTING HYDROCARBON OILS

(75) Inventor: Ramesh Varadaraj, Flemington, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 98 days.

(21) Appl. No.: 12/798,049

(22) Filed: Mar. 29, 2010

(65) Prior Publication Data

US 2010/0234247 A1 Sep. 16, 2010

Related U.S. Application Data

(63) Continuation-in-part of application No. 11/173,975, filed on Jul. 1, 2005, now abandoned.

(60) Provisional application No. 60/590,891, filed on Jul. 23, 2004.

(51) Int. Cl.

| | |
|---|---|
| ***C10G 33/04*** | (2006.01) |
| ***C10G 29/20*** | (2006.01) |
| ***C10G 29/22*** | (2006.01) |
| ***C10G 29/02*** | (2006.01) |

(52) U.S. Cl.

USPC ..... 208/188; 208/178; 208/237; 208/238; 208/240; 208/254 R; 208/263; 208/291; 208/298

(58) Field of Classification Search ..... 166/246, 166/252, 270.1; 204/570; 208/177, 188, 208/299, 178, 237, 238, 240, 254 R, 263, 208/291, 298; 210/24, 787; 260/674 SA, 260/676 AD See application file for complete search history.

(56) References Cited

U.S. PATENT DOCUMENTS

| | | | | | |
|---|---|---|---|---|---|
| 2,182,145 | A | * | 12/1939 | Eddy | 204/570 |
| 3,922,217 | A | * | 11/1975 | Cohen et al. | 208/299 |
| 4,941,533 | A | * | 7/1990 | Buller et al. | 166/270 |
| 5,219,471 | A | * | 6/1993 | Goyal et al. | 210/787 |

* cited by examiner

*Primary Examiner* — Randy Boyer

(57) ABSTRACT

A method for separating polar hydrocarbon compounds from a hydrocarbon oil containing polar hydrocarbon compounds comprising the steps of:

a) forming a gel in the hydrocarbon oil, and thereafter b) separating the gel from the hydrocarbon oil to produce a separated gel and a separated hydrocarbon oil.

31 Claims, No Drawings

GEL ASSISTED SEPARATION METHOD AND DEWATERING/DESALTING HYDROCARBON OILS

Continuation-In-Part of U.S. Ser. No. 11/173,975 filed Jul. 1, 2005 now abandoned which is based on U.S. Provisional Application 60/590,891 filed Jul. 23, 2004.

FIELD OF THE INVENTION

The invention relates to separating polar hydrocarbons from hydrocarbon oils. The invention also relates to desalting and/or dewatering hydrocarbon oils. The invention also relates to recovering crude oil from a subterranean environment.

BACKGROUND

Hydrocarbon oils, particularly heavy crude oils, contain polar hydrocarbon compounds such as naphthenic acids, nitrogen and sulfur containing hydrocarbon compounds and pose problems in refining. There is a need to upgrade such hydrocarbon oils. Separation of polar hydrocarbon compounds such as naphthenic acids, nitrogen and sulfur containing hydrocarbon compounds from crude oils results in upgrading. The present invention addresses this need.

Hydrocarbon oils, particularly crude oils when produced comprise varying amounts of water and inorganic salts like halogens, sulfates and carbonates of Group I and Group II elements of The Periodic Table of Elements. (The Periodic Table of Elements is the common long form of the periodic table; Advanced Inorganic Chemistry by F. A Cotton and G. Wilkinson Interscience Publishers, 1962) Removal of water from produced crude oils is termed dewatering and salt removal is termed desalting. Often, the process of dewatering also desalts the crude oil since water-soluble salts are removed with the water.

Dewatering the produced crude oil is desired at crude oil production facilities as it impacts the value of crude oil and its economic transportation. The presence of salts, especially chlorides of Group I and Group II elements of The Periodic Table of Elements, corrode oil processing equipment. In order to mitigate the effects of corrosion, it is advantageous to reduce the salt concentration to the range of 1 to 5 ppm or less and water content to about 0.25 to 1 wt % by weight of the crude oil prior to transportation and processing of the oil.

Among the crude oil dewatering and/or desalting methods in use today, electrostatic separation methods are commonly used. Heavy crude oils containing high concentrations of asphaltenes, resins, waxes, and napthenic acids are difficult to dewater and desalt and usually require longer processing times, higher process operation temperatures and higher concentrations of demulsifier chemicals to effect the desired dewatering and desalting. As a result of these processing requirements for heavy crude oils the process throughput is lowered and costs for dewatering and desalting increased. Consequently, there is a need for improved crude oil dewatering and/or desalting methods that improve the efficiency of dewatering and/or desalting especially with heavy crude oils containing asphaltenes and naphthenic acids. The present invention also addresses this need.

SUMMARY OF THE INVENTION

In one embodiment is a method for separating polar hydrocarbon compounds from a hydrocarbon oil containing polar hydrocarbon compounds comprising the steps of:

a) forming a gel in the hydrocarbon oil, and thereafter b) separating the gel from the hydrocarbon oil to produce a separated gel and a separated hydrocarbon oil.

In another embodiment is a method for dewatering and/or desalting a hydrocarbon oil containing water and salt comprising the steps of:

a) forming a gel in the hydrocarbon oil, b) separating the gel from the hydrocarbon oil to produce a separated gel and a separated hydrocarbon oil, and thereafter, c) further separating water and salt from the separated hydrocarbon oil to provide a dewatered and desalted hydrocarbon oil.

Another embodiment is a method for separating polar hydrocarbon compounds from a hydrocarbon oil containing polar hydrocarbon compounds comprising the steps of:

a) adding a gel forming agent comprising water to the hydrocarbon oil;

b) subjecting the hydrocarbon oil and the gel forming agent comprising water to a process selected from the group consisting of temperature cycling, pressure cycling, shear cycling, sonic cycling, and combinations thereof to form a gel, c) separating the gel from the hydrocarbon oil to produce a separated gel comprising water, water soluble salts and water insoluble salts and a separated hydrocarbon oil, said separation of the gel from the hydrocarbon oil is by a process selected from the group consisting of gravity settling, centrifugation, hydrocyclone treatment, filtration and combinations thereof.

Another embodiment is a method for dewatering and/or desalting a hydrocarbon oil containing water and salt comprising the steps of:

a) adding a gel forming agent comprising water to the hydrocarbon oil;

b) subjecting the hydrocarbon oil and the gel forming agent comprising water to a process selected from the group consisting of temperature cycling, pressure cycling, shear cycling, sonic cycling, and combinations thereof to form a gel, c) separating the gel from the hydrocarbon oil to produce a separated gel comprising water, water soluble salts and water insoluble salts and a separated hydrocarbon oil, said separation of the gel from the hydrocarbon oil is by a process selected from the group consisting of gravity settling, centrifugation, hydrocyclone treatment, filtration and combinations thereof, and d) further separating water and salt from the separated hydrocarbon oil to provide a dewatered and desalted hydrocarbon oil.

Another embodiment is a method for recovering crude oil from a subterranean environment comprising the steps of:

a) adding a gel forming agent comprising water to a hydrocarbon oil;

b) subjecting the hydrocarbon oil and the gel forming agent comprising water to a process selected from the group consisting of temperature cycling, pressure cycling, shear cycling, sonic cycling, and combinations thereof to form a gel, c) separating the gel from the hydrocarbon oil to produce a separated gel comprising water, water soluble salts and water insoluble salts and a separated hydrocarbon oil, said separation of the gel from the hydrocarbon oil is by a process selected from the group consisting of gravity settling, centrifugation, hydrocyclone treatment, filtration and combinations thereof, and d) thereafter injecting the separated gel into the subterranean environment and recovering crude oil from said environment.

DETAILED DESCRIPTION OF THE PREFERRED EMBODIMENTS

The gel separation method of the instant invention is useful for hydrocarbon oils comprising polar hydrocarbon compounds. It is particularly useful for crude oils that contain polar hydrocarbon compounds such as naphthenic acids, asphaltenes and metalloprophyrins. Separation of the polar hydrocarbon compounds from the crude oil results in a upgraded crude oil. Preferred hydrocarbon oils are hydrocarbon oils selected from the group consisting of crude oil, crude oil distillate, crude oil residuum or mixtures thereof.

The desalting and/or dewatering method of the instant invention is useful for hydrocarbon oils comprising salts, water and mixtures thereof. It is particularly useful for heavy and waxy crude oils that are generally difficult to dewater and/or desalt. The salts present in the hydrocarbon oil are inorganic salts including halogens, sulfates and carbonates of Group I and Group II elements of The Periodic Table of Elements. The concentration of the salts can vary from about 0.001 to 10 wt % based on the weight of the hydrocarbon oil. The process is effective for both water-soluble and water insoluble salts that are suspended in the hydrocarbon oil. The water content of the hydrocarbon oil-water mixture can vary in the range of 0.5 wt % to 20 wt % based on the weight of the hydrocarbon-water mixture. The hydrocarbon oil required to be dewatered and/or desalted can be a crude oil, crude oil distillate, and crude oil residuum obtained from distillation or mixtures thereof. Generally the water of the hydrocarbon oil is in a form wherein the water is dispersed as droplets in the hydrocarbon oil. In this form of occurrence the hydrocarbon oil-water mixture is generally a water-in oil emulsion.

The gel of the invention is a complex fluid comprising hydrocarbon oil, water, water soluble salts such as sodium, potassium and calcium chlorides, water insoluble salts such as calcium carbonate and calcium sulfate, organic carbonaceous solids like coal and coke, crude oil derived compounds such as asphaltenes, naphthenic acids, naphthenic acids salts such as sodium and calcium naphthenates, organo sulfur compounds, organo nitrogen containing compounds and metalloporphyrins. The crude oil derived compounds in the gel are polar hydrocarbon compounds, preferably surface active polar hydrocarbon compounds, and more preferably surface active polar hydrocarbon compounds that are surface active at a hydrocarbon-water interface. Surface activity of the polar hydrocarbon compounds can be determined using known tensiometric techniques such as hydrocarbon/water interfacial tension by one of ordinary skill in the art of interfacial science.

The gel has physical properties suitable for separation from the hydrocarbon oil from which it is formed. Preferably the density of the gel is greater than that of the hydrocarbon oil at the temperature the method is conducted. More preferably the density is greater than that of the hydrocarbon oil and less than that of water at the temperature the method is conducted. The density of the gel being greater than that of the hydrocarbon oil and less than that of water allows easy separation of the gel from the hydrocarbon oil. The gel is preferably viscoelastic. Viscoelastic properties of materials is known to one of ordinary skill in the art of rheology. By virtue of its viscoelastic nature the gel has an elastic modulus and a viscous modulus. The elastic modulus and viscous modulus of the viscoelastic gel can be measured by one of ordinary skill in the art of fluid rheology using oscillatory visometry techniques. Preferably the viscous modulus of the gel is at least two times that of the hydrocarbon oil from which it is formed at a given temperature. Preferably the elastic modulus of the gel is at least two times that of the hydrocarbon oil from which it is formed at a given temperature. The gel has physical properties suitable for use as a pusher fluid or drive fluid in enhanced crude oil recovery processes.

The first step of the method is to form a gel in a hydrocarbon oil. To form the gel, a variety of methods can be employed. Gel forming agents including but not limited to water, lignin, cellulose, coke fines, coal fines, cholesteryl and cholestanyl derived gellation compounds and oxidized alkyl aromatic hydrocarbons can be added to the crude oil to promote gel formation. U.S. Pat. No. 3,922,217 discloses the use of a resin to form a gel. Applicant has found that a gel can be formed without the use of a resin. Water alone can be used to form a gel. In one embodiment of the invention, water is a preferred gel-forming agent. One disadvantage of using a resin as a gel forming agent is that there is chemical contamination of the crude oil with the resin chemical. Another disadvantage is that the yields of the upgraded oil is lower when a resin is used as a gel forming agent. Yet another disadvantage of using a resin is the higher cost relative to water. Yet another disadvantage of using a resin is the complexity of the process of separating the gel from the crude oil. These and other disadvantages are overcome by the use of water as a gel-forming agent. The long standing problem of a cost effective upgrading of crude oil via separation of crude oil polar compounds is achieved by the instant invention.

The amount of gel forming agent to be added can vary in the range of 0.01 to 20 wt % based on the weight of the hydrocarbon oil. When water is the gel forming agent it is preferred to add water also the range of 0.01 to 20 wt % based on the weight of the hydrocarbon oil. More preferrably water is in the range of 0.01 to 10 wt % based on the weight of the hydrocarbon oil. Water addition can be in one lot or in aliquots. After addition of the gel forming agent the hydrocarbon oil is mixed and allowed to stand for a period of time and at a temperature sufficient to promote gel formation. Mixing can be conducted during or after addition of the gel forming agent. The preferred temperature of addition and mixing is in the range of about 15° C. to about 85° C. and preferred period of time of addition and mixing is in the range of 5 minutes to 10 days.

Another example of forming a gel from a hydrocarbon oil is to subject the hydrocarbon oil or the mixture of hydrocarbon oil and gel forming agent to temperature cycles i.e., increase and decrease the temperature of the hydrocarbon oil in a temperature range several times. This is particularly effective and preferred when water is used as the gel forming agent. Preferrably the temperature cycling is in the temperature range of 10° C. to 90° C. at atmospheric pressure and the number of cycles is at least 2 and the total time period of cycling is from 5 minutes to 10 days. In another example a hydrocarbon oil is subject to pressure cycles in a suitable pressure range. A pressure in the range of 14 psia (96.46 kPa) to 150 psia (1033.5 kPa) is preferred. The hydrocarbon oil can be subject to both temperature and pressure cycles at the same time. In yet another example the hydrocarbon oil can be subject to shear cycling i.e., subject the hydrocarbon oil to shearing forces of varying intensities. This can be accomplished for example by subjecting the hydrocarbon oil to turbulent force field followed by a quiescent force field. The hydrocarbon oil can also be subject to sonic treatment cycles. In this embodiment the hydrocarbon oil is subject to cycles of ultrasonic waves by turning on and turning off the ultrasonicator alternately for a period of time sufficient to form the gel. The temperature, pressure, electrostatic, sonic and shear cycle treatments can be conducted on the hydrocarbon oil or on the hydrocarbon oil treated with gel forming agents. For example, one can treat the hydrocarbon oil with water and then subject it to the temperature, pressure, electrostatic, sonic or shear cycle treatments to promote gel formation. In another example, one can treat the hydrocarbon oil with water and gel forming agents selected from the group consisting of lignin, cellulose, coke fines, coal fines, cholesteryl and cholestanyl derived gellation compounds and oxidized alkyl aromatic hydrocarbons and then subject it to the temperature, pressure, electrostatic, sonic or shear cycle treatments to promote gel formation.

In yet another example the hydrocarbon oil can be subject to cycling in electrostatic fields. U.S. Pat. No. 2,182,145 discloses applying electrostatic fields to separate water from crude oils. Therein, the water droplets are coalesced and water is separated as a separate phase. U.S. Pat. No. 2,182,145 teaches away from forming gels and does not disclose applying electrostatic fields in cycles. Applicant has found that gel formation is desirable and results in removal of polar hydrocarbons. However, when electrostatic fields are employed in the gel forming step it is essential to cycle the electrostatic field that is applied to the mixture of crude oil and gel forming agents. Preferably, the voltage gradient of the applied electrostatic field is in a range conducive for gel formation. This voltage gradient is preferably in the range of 500 volts per inch to about 5,000 volts per inch, more preferably 500 volts to 2000 volts and even more preferably 500 volts to 1000 volts. Residence times in the electrostatic fields range from about 0.5 to about 120 minutes, preferably from about 0.5 to about 15 minutes. It is preferable to perform at least one cycle and more preferably at least two cycles. In general, one cycle is defined as going from an initial state to a final state, coming back to initial state and going to the same final state and coming back to the initial state.

The amount of gel formed in the hydrocarbon oil is an amount sufficient to extract at least 1 weight percent of polar hydrocarbon compounds in the starting hydrocarbon oil, preferably at least 1 weight percent surface active polar hydrocarbon compounds, and more preferably at least 1 weight percent surface active polar hydrocarbon compounds that are surface active at a hydrocarbon-water interface. Preferably the surface active polar hydrocarbon compounds are nitrogen, oxygen, sulfur and metals containing surface active compounds of the hydrocarbon oil. The total amount of polar hydrocarbon compounds of the hydrocarbon oil can be measured by one of ordinary skill in the art of organic compound analyses. Preferably, the amount of gel that is formed is in the range of 0.5 to 20 wt % based on the initial weight of the hydrocarbon oil. More preferrably the amount of gel that is formed is in the range of 0.5 to 10 wt % based on the initial weight of the hydrocarbon oil.

The second step of the method comprises separating the gel from the hydrocarbon oil to produce a separated gel and a separated hydrocarbon oil. This separation can be accomplished by methods known to one of ordinary skill in the art of separations. The system for separation can be considered as a liquid-viscoelastic gel system. Because of the favorable density and viscoelastic properties of the formed gel the preferred separation method is gravity settling followed by removal of the top oil phase. Centrifugation or hydrocyclone techniques can also be employed to increase the rate of separation of the gel from the treated oil. Suitable centrifugal force fields can be applied for the separation. Suitable filtration methods can also be employed. For example, for gels formed from crude oils one can use a mineral or rock bed such as a gravel bed as a filtration medium to filter off or separate the gel from the oil. Other filtration media such as membrane filters can also be used. After gel formation and separation, the separated hydrocarbon oil contains polar hydrocarbon compounds that are at least 1 wt % less than the starting hydrocarbon.

The last step of the method for dewatering and desalting is separating water and salt from the separated hydrocarbon oil. Methods known for separating water and salt from the hydrocarbons oils can be employed. These include methods such as electrostatic separation, centrifugation and hydrocyclone treatment. Electrostatic separation is the preferred method to separate the water and salts from the separated hydrocarbon oil. Preferably demulsifier chemicals known to one of ordinary skill in the art of dewatering and desalting hydrocarbon oils are added to the separated hydrocarbon oil and subject to electrostatic treatment to provide the dewatered desalted oil.

One aspect of the invention is the enhanced recovery of crude oil from a subterranean environment using the gel of the instant invention. The subterranean environment comprising cruide oil is also known as a hydrocarbon reservoir. The instant invention can be practiced at a crude oil production facility and the separated gel is injected into a hydrocarbon reservoir. The gel functions as the drive fluid or pusher fluid. The gel has stability and rheological properties (disclosed in paragraph 0015) suitable to improve recovery of crude oil. Preferably, the viscosity of the gel is at least 1.5 to 5 times the viscosity of the oil that it displaces in the reservoir.

The following non-limiting examples illustrate one embodiment of the invention.

Step-1: Gel Formation 100 grams of a crude oil from Canada was used. To the crude oil was added 1 wt % water based on the weight of the crude oil. The crude oil was subject to temperature cycling by heating the crude oil to 60° C. and holding the temperature at 60° C. for 30 minutes. The sample was then cooled to 25° C. The heating and cooling was conducted five times. The sample was then allowed to gravity settle for 5 days.

After 5 days a gel layer was observed to settle at the bottom of the jar containing the temperature cycled oil. The amount of gel formed was 5 wt % based on the initial weight of the crude oil. A bright light source held in front or behind the jar containing the oil was sufficient to detect the gel layer.

Step-2: Separation of Oil and Gel

The oil residing on top of the gel was carefully siphoned off to provide the separated oil (denoted, sample-1). The gel was at the bottom of the jar and is the separated gel (denoted, gel sample-G).

Step-3: Separation of Water and Salts from the Separated Oil (Electrostatic Treatment)

Two samples were examined. Sample-1 was the separated oil (obtained from step 2) and Sample-2 untreated Canadian crude oil. Water (5 wt %) was added to samples 1 and 2 and both samples shaken for 5 minutes on a wrist shaker. A phenol formaldehyde ethoxylated alcohol demulsifier formulation sold by BASF Corporation as Pluradyne DB7946 was added to both samples at a treat rate of 100 ppm based on the weight of crude oil and the mixture shaken on a wrist shaker for an additional 10 minutes. Both samples were subject to electrostatic demulsification by applying 830 volts/square inch AC current to the samples at 60 C for 1 hour. After completion of the procedure the samples were examined and amount of water separating out recorded. The samples were also analyzed for sodium content by Inductively Coupled Plasma (ICP) analyses. Sample-2 did not demulsify under the conditions of the experiment and no water was observed to split out at the bottom of the demulsifier vessel. In Sample-1, 97% dewatering and 80% reduction in salt content was observed. Thus, formation and separation of the gel results in effective dewatering and desalting whereas the untreated crude oil does not demulsify under the same conditions.

Analyses of the Separated Gel

The separated gel (gel sample-G) from step 2 was subject to rheological analyses using oscillatory viscometry. A Haake viscometer in the oscillating mode was used and analyses conducted at 25° C. The separated gel (gel sample-G) had a viscous modulus of 32.5 Pascal and an elastic modulus of 4.4 Pascal. In contrast, the separated oil (sample-2) had a viscous modulus of 7.7 Pascal an elastic modulus of 0.7 Pascal. Thus the formed gel has a significantly higher elastic and viscous modulus compared to the crude oil.

Next, the gel phase was subject to component analysis. The gel was found to contain 95% oil and 5% water. The oil and water from the separated gel was analyzed. The oil of the gel (Gel Oil) was itself observed to have a micro-concarbon residue (MCCR), naphthenic acid (TAN), basic nitrogen and sulfur level higher than the separated oil (sample-2) obtained from step-2. Additionally, the surface activity of the oil from the gel was an order of magnitude higher than the surface activity of the separated oil. This is evident in the oil/water interfacial tension {IFT (o/w)} values. Thus, in the method of the invention the gel extracts the most surface active sulfur, nitrogen and naphthenic acid compounds. Results of the analyses are shown in Table-1.

In a comparative experiment, 100 grams of a crude oil from Canada was used. To the crude oil was added 2 wt % of an ion exchange resin, Dowex C-211 (55% Styrene/Divinylbenzene Copolymer, 45% water) based on the weight of the crude oil. The crude oil and resin mixture was subject to temperature cycling by heating the crude oil to 60° C. and holding the temperature at 60° C. for 30 minutes. The sample was then cooled to 25° C. The heating and cooling was conducted five times. The sample was then allowed to gravity settle for 5 days. After 5 days, no clear phase separation was observed and no separate gel layer could not be separated. This experiment demonstrates the resin is incapable of separating crude oil polars using temperature cycling and gravity settling.

TABLE 1

| Oil | S (%) | Total N (ppm) | Basic N (ppm) | TAN | MCCR | IFT (o/w) dynes/cm |
|---|---|---|---|---|---|---|
| Separated Oil | 3.0 | 3800 | 960 | 0.99 | 6 | 20 |
| Gel Oil | 4.0 | 4700 | 1200 | 1.82 | 13 | 2 |

What is claimed is:

1. A method for separating polar hydrocarbon compounds from a hydrocarbon oil containing polar hydrocarbon compounds comprising the steps of:

a) adding a gel forming agent comprising water to the hydrocarbon oil;

b) subjecting the hydrocarbon oil and the gel forming agent comprising water to a process selected from the group consisting of temperature cycling, pressure cycling, shear cycling, sonic cycling, and combinations thereof to form a gel, wherein the gel is formed without using a resin;

c) separating the gel from the hydrocarbon oil to produce a separated gel comprising water, water soluble salt, and water insoluble salts, and a separated hydrocarbon oil, said separation of the gel from the hydrocarbon oil is by a process selected from the group consisting of gravity settling, centrifugation, hydrocyclone treatment, filtration, and combinations thereof.

2. The method of claim 1 wherein said separated hydrocarbon oil contains said polar hydrocarbon compounds that are at least 1 wt % less than in the hydrocarbon oil.

3. The method of claim 1 wherein said hydrocarbon oil is selected from the group consisting of crude oil, crude oil distillate, crude oil residuum or mixtures thereof.

4. The method of claim 1 wherein said gel has a density greater than the density of the hydrocarbon oil at the temperature at which step b) is conducted.

5. The method of claim 1 wherein the amount of gel formed in the hydrocarbon oil is in the range of 0.5 to 20 wt % based on the weight of the hydrocarbon oil.

6. The method of claim 1 wherein said water is in the range of 0.01 to 10 wt % based on the weight of the hydrocarbon oil.

7. The method of claim 1 wherein said temperature cycling is in the temperature range of 10° C. to 90° C. at atmospheric pressure, the number of cycles is at least 2, and the total time period of cycling is from 5 minutes to 10 days.

8. A method for dewatering and/or desalting a hydrocarbon oil containing water and salt comprising the steps of:

a) adding a gel forming agent comprising water to the hydrocarbon oil;

b) subjecting the hydrocarbon oil and the gel forming agent comprising water to a process selected from the group consisting of temperature cycling, pressure cycling, shear cycling, sonic cycling, and combinations thereof to form a gel, wherein the gel is formed without using a resin;

c) separating the gel from the hydrocarbon oil to produce a separated gel comprising water, water soluble salt, and water insoluble salts, and a separated hydrocarbon oil, said separation of the gel from the hydrocarbon oil is by a process selected from the group consisting of gravity settling, centrifugation, hydrocyclone treatment, filtration, and combinations thereof, and thereafter;

d) further separating water and salt from the separated hydrocarbon oil to provide a dewatered and desalted hydrocarbon oil.

9. The method of claim 8 wherein said separation of water and salt from the separated hydrocarbon oil in step d) is by electrostatic treatment.

10. The method of claim 8 wherein said hydrocarbon oil is selected from the group consisting of crude oil, crude oil distillate, crude oil residuum or mixtures thereof.

11. The method of claim 8 wherein said hydrocarbon oil contains asphaltenes and naphthenic acids.

12. The method of claim 8 wherein said gel is viscoleastic.

13. The method of claim 8 wherein said gel has a density greater than the density of the hydrocarbon oil at the temperature at which step b) is conducted.

14. The method of claim 8 wherein said gel has a density greater than the density of the hydrocarbon oil and lower than the density of water at the temperature at which step b) is conducted.

15. The method of claim 8 wherein the amount of gel formed in the hydrocarbon oil is an amount sufficient to extract at least 1 wt % of polar hydrocarbons compounds from the hydrocarbon oil.

16. The method of claim 8 wherein the amount of gel formed in the hydrocarbon oil is in the range of 0.5 to 20 wt % based on the weight of the hydrocarbon oil.

17. The method of claim 8 wherein said water is in the range of 0.01 to 10 wt % based on the weight of the hydrocarbon oil.

18. The method of claim 8 wherein said temperature cycling is in the temperature range of 10° C. to 90° C. at atmospheric pressure, the number of cycles is at least 2, and the total time period of cycling is from 5 minutes to 10 days.

19. The method of claim 1 wherein the water soluble salts are selected from the group consisting of sodium, potassium, calcium chlorides and any combination thereof and the water insoluble salts are selected from the group consisting of calcium carbonate, calcium sulfate and any combination thereof and further comprising crude oil derived compounds selected from the group consisting of asphaltenes, naphthenic acids, naphthenic acids salts such as sodium and calcium naphthenates, organo sulfur compounds, organo nitrogen containing compounds and any combination thereof and organic carbonaceous solids selected from the group consisting of coal, coke, and any combination thereof.

20. The method of claim 1 wherein the hydrocarbon oil comprises surface active polar hydrocarbon compounds that are surface active at a hydrocarbon water interface.

21. The method of claim 8 wherein the water soluble salts are selected from the group consisting of sodium, potassium, calcium chlorides and any combination thereof and the water insoluble salts are selected from the group consisting of calcium carbonate, calcium sulfate and any combination thereof and further comprising crude oil derived compounds selected from the group consisting of asphaltenes, naphthenic acids, naphthenic acids salts such as sodium and calcium naphthenates, organo sulfur compounds, organo nitrogen containing compounds and any combination thereof and organic carbonaceous solids selected from the group consisting of coal, coke, and any combination thereof.

22. The method of claim 8 wherein the hydrocarbon oil comprises surface active polar hydrocarbon compounds that are surface active at a hydrocarbon water interface.

23. The method of claim 8 further comprising adding a demulsifier chemical to the separated hydrocarbon oil and subjecting the separated hydrocarbon oil to electrostatic treatment to provide the dewatered desalted oil.

24. The method of claim 1 further comprising injecting the separated gel in a hydrocarbon reservoir.

25. The method of claim 8 further comprising injecting the separated gel in a hydrocarbon reservoir.

26. A method for recovering crude oil from a subterranean environment comprising the steps of:

a) adding a gel forming agent comprising water to a hydrocarbon oil;

b) subjecting the hydrocarbon oil and the gel forming agent comprising water to a process selected from the group consisting of temperature cycling, pressure cycling, shear cycling, sonic cycling, and combinations thereof to form a gel, wherein the gel is formed without using a resin;

c) separating the gel from the hydrocarbon oil to produce a separated gel comprising water, water soluble salts, and water insoluble salts, and a separated hydrocarbon oil, said separation of the gel from the hydrocarbon oil being by a process selected from the group consisting of gravity settling, centrifugation, hydrocyclone treatment, filtration, and combinations thereof; and d) thereafter injecting the separated gel into the subterranean environment and recovering crude oil from said environment.

27. The method of claim 1 wherein the gel forming agent further comprises another gel forming agent selected from the group consisting of lignin, cellulose, coke fines, coal fines, cholesteryl and cholestanyl derived gellation compounds and oxidized alkyl aromatic hydrocarbons, and any combination thereof.

28. The method of claim 8 wherein the gel forming agent further comprises another gel forming agent selected from the group consisting of lignin, cellulose, coke fines, coal fines, cholesteryl and cholestanyl derived gellation compounds and oxidized alkyl aromatic hydrocarbons, and any combination thereof.

29. The method of claim 26 wherein the gel forming agent further comprises another gel forming agent selected from the group consisting of lignin, cellulose, coke fines, coal fines, cholesteryl and cholestanyl derived gellation compounds and oxidized alkyl aromatic hydrocarbons, and any combination thereof.

30. The method of claim 1 wherein the gel forming agent consists essentially of water and optionally one or more of lignin, cellulose, coke fines, coal fines, cholesteryl and cholestanyl derived gellation compounds, and oxidized alkyl aromatic hydrocarbons.

31. The method of claim 8 wherein the gel forming agent consists essentially of water and optionally one or more of lignin, cellulose, coke fines, coal fines, cholesteryl and cholestanyl derived gellation compounds, and oxidized alkyl aromatic hydrocarbons.

* * * * *